US005428426A

United States Patent [19]

Inomata et al.

[11] Patent Number: 5,428,426

[45] Date of Patent: Jun. 27, 1995

[54] IMAGE FORMING SYSTEM

[75] Inventors: Mitsugu Inomata, Kawasaki; Hisayoshi Kojima, Yokohama; Toshiki Nagase; Toshiaki Miyashiro, both of Tokyo, all of Japan

[73] Assignee: Canon Kabushiki Kaisha, Tokyo, Japan

[21] Appl. No.: 329,618

[22] Filed: Oct. 26, 1994

Related U.S. Application Data

[63] Continuation of Ser. No. 132,213, Oct. 6, 1993, abandoned, which is a continuation of Ser. No. 878,991, May 6, 1992, abandoned.

[30] Foreign Application Priority Data

May 10, 1991 [JP] Japan ..... 3-133351
May 31, 1991 [JP] Japan ..... 3-156088
Jun. 15, 1991 [JP] Japan ..... 3-159950

[51] Int. Cl.[6] ..... G03G 5/00
[52] U.S. Cl. ..... 355/211; 355/277
[58] Field of Search ..... 355/200, 210, 211, 271, 355/274, 277

[56] References Cited

U.S. PATENT DOCUMENTS

| | | | |
|---|---|---|---|
| 3,985,435 | 10/1976 | Suzuki et al. | 355/327 |
| 4,432,632 | 2/1984 | Youota | 355/245 |
| 4,935,778 | 6/1990 | Mochida | 355/211 |
| 5,030,988 | 7/1991 | Haneda et al. | 355/200 |
| 5,087,939 | 2/1992 | McDougal | 355/200 |
| 5,126,800 | 6/1992 | Shishido et al. | 355/211 |

*Primary Examiner*—Leo P. Picard
*Assistant Examiner*—Christopher Horgan
*Attorney, Agent, or Firm*—Fitzpatrick, Cella, Harper & Scinto

[57] ABSTRACT

The present invention provides the image forming system in which, when an image bearing member or a process cartridge including an image bearing member therein is mounted within an image forming system having a shiftable image forming device, the image bearing member can receive a driving force from the image forming device. Consequently, it is possible to reduce the number of positioning locations between the image forming system and the image bearing member.

12 Claims, 18 Drawing Sheets

IMAGE FORMING SYSTEM

This application is a continuation-in-part continuation of application Ser. No. 08/132,213 filed Oct. 6, 1993, now abandoned, which is a continuation of application Ser. No. 07/878,991, filed May 6, 1992, now abandoned.

BACKGROUND OF THE INVENTION

Field of The Invention

The present invention relates to an image forming system such as a copying printer and the like, and more particularly, it relates to an image forming system wherein at least a "shiftable or movable image bearing member" is detachable.

Related Background Art

In order to faithfully reproduce image information for obtaining the good image, the high accurate assembling technique is required. For example, in an image forming system wherein a full-color image is obtained by sequentially superimposing color toner images formed on a photosensitive drum on a recording sheet carried by a rotating transfer drum, not only is highly accurate control of image formation is required for preventing the discrepancy in colors, but also it is very important to accurately determine the relative positions between parts (particularly, the relative position between an image bearing member and image forming means such as a transfer drum and the like). This is also true regarding mono-color image forming systems, as well as the full-color image forming systems.

In addition, recently, in consideration of easy maintenance image forming systems, process cartridges which are detachable with respect to the image forming systems and which incorporate therein a photosensitive member, developing device and the like integrally have been widely used.

When such a process cartridge is mounted within the image forming system, it is naturally required to position the photosensitive member in the cartridge with respect to the image forming means in the image forming system. A moving part such as the photosensitive member is also required to be positioned with respect to a drive means for transmitting a driving force from a driving force source to the photosensitive member.

Thus, in an image forming system wherein at least a shiftable image bearing member is detachable, there are two accurate positioning requirements for obtaining the relative position between, first, the image bearing member and the image forming means, and the relative position between the image bearing member and the drive means. Thus, these systems were very complicated.

Further, since the photosensitive drum had to be positioned with respect to the drive means of the image forming system and to the transfer drum with high accuracy, the mounting and dismounting of the process cartridge, with respect to the image forming system, was limited, thus worsening the operability of the process cartridge. Furthermore, since there were at least two locations where high accuracy positioning was required, the rotational accuracy of the photosensitive drum was affected two-fold, by the accuracy of placement of parts constituting such these two locations, thus reducing the rotational accuracy of the photosensitive drum. This two-fold dependency would frequently result in the unevenness of pitches of the images.

SUMMARY OF THE INVENTION

The present invention aims to eliminate the above-mentioned conventional drawbacks, and an object of the present invention is to provide an image forming system which can facilitate positioning when an image bearing member is mounted within the image forming system.

Another object of the present invention is to provide an image forming system wherein an image bearing member can receive a driving force from an image forming system when the former is mounted within the latter.

The other objects of the present invention will be apparent from the following explanation.

DETAILED DESCRIPTION OF THE PREFERRED EMBODIMENTS

The present invention will now be explained in connection with embodiments thereof with reference to the accompanying drawings.

Incidentally, herein, an example that a process cartridge constituted by integrally incorporating a charger means, an image bearing member, a plurality of developing means and a cleaning means can be removably mounted within an image forming system will be explained. However, it should be noted that the present invention is not limited to such example, but may be applied to an image forming system wherein only an image bearing member is detachable, or an image forming system wherein a process cartridge including an image bearing member and at least one of "a charger means for uniformly charging the image bearing member, a developing means for developing a latent image formed on the image bearing member, and a cleaning means for removing the residual matters remaining on the image bearing member" is detachable with respect to the image forming system.

First of all, a first embodiment of the present invention will be explained.

Figure 7:
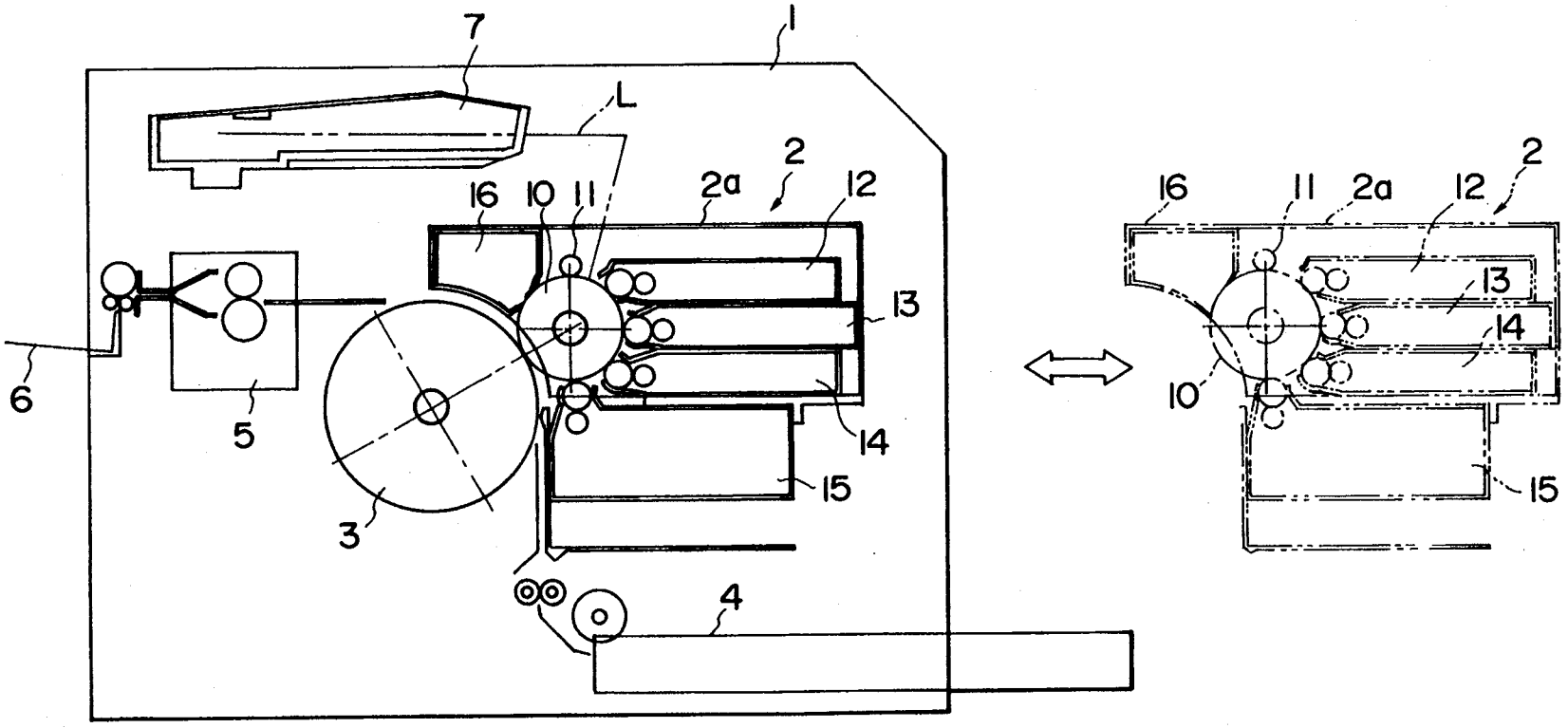
FIG. 7 is an elevational sectional view showing an example of an image forming system to which the present invention is applied, and a process cartridge used therewith.

FIG. 7 is an elevational sectional view of an image forming system capable of forming a multi-color image. In FIG. 7, a charger roller 11, a plurality of developing devices 12, 13, 14 and 15 for yellow, magenta, cyan and black colors, and respectively, and a cleaning device 16 are disposed around a photosensitive drum 10 rotated in a given direction. These process means 11–16 are integrally housed within a cartridge container 2*a* to form a process cartridge 2 which can be removably or detachably mounted within an image forming system 1, thus facilitating cartridge and apparatus maintenance and the like.

Further, a rotating transfer drum (image forming means) 3 for holding a transfer sheet thereon is disposed adjacent to the photosensitive drum 10. A sheet supply unit 4 is arranged at an upstream side of the transfer drum 3, and a fixing unit 5 and an ejection tray 6 are arranged at a downstream side of the transfer drum. Further, an optical unit 7 is disposed above the process cartridge 2. That is to say, when an electrostatic latent image corresponding to an yellow image is formed on the photosensitive drum 10 by exposing the photosensitive drum 10 uniformly charged by the charger roller 11 with image light L corresponding to yellow image information from the optical unit 7, the electrostatic latent image is directed or rotated together with the photosensitive drum 10 toward the developing device 12 for the yellow color, where the latent image is visualized as an yellow toner image by the developing device 12. When the photosensitive drum 10 is further rotated, the yellow toner image is transferred onto the recording sheet carried by the transfer drum 3 rotated in synchrony with the photosensitive drum 10, at a transfer station.

After the transferring operation, the photosensitive drum 10 is cleaned by the cleaning device 16, and is then uniformly charged by the charger roller 11 again. Then, the photosensitive drum 10 is exposed by image light L corresponding to magenta image information from the optical unit 7, thus forming a new electrostatic latent image. This electrostatic latent image is visualized as a magenta toner image by the developing device 13 including magenta toner. Then, the magenta toner image is superimposed on the yellow toner image on the transfer sheet carried by the transfer drum in registration with the yellow image.

Similarly, toner images are formed on the photosensitive drum 10 via the developing devices 14 and 15 for cyan and black colors respectively, and thus cyan image information and black image information are sequentially superimposed onto the transfer sheet.

On the other hand, a transfer sheet is fed from the sheet supply unit 4 to the transfer drum 3 and is positioned there. Then, in response to the rotations of the transfer drum 3, the various color toner images are sequentially superimposed on the transfer sheet at the transfer station as mentioned above. After the transferring operation, the transfer sheet is fed from the transfer drum 3 to the fixing unit 5, where the toner images are fused and mixed by heat and pressure from the fixing device 5 and, thus, are fixed onto the sheet as a permanent image. Thereafter, the transfer sheet is ejected onto the ejection tray 6.

The photosensitive drum 10 in the process cartridge 2 must be rotated by a driving member of the image forming system 1, and the transfer drum 3 must be rotated in relation to the photosensitive drum 10 since the rotation of the transfer drum must be in synchrony with the rotation of the photosensitive drum. In general, the transfer drum 3 was often rotated via the photosensitive drum 10. In this case, when the process cartridge 2 was positioned in the image forming system 1, it was necessary to position the photosensitive drum 10 with respect to both the driving member of the image forming system 1 and the transfer drum 3 with high accuracy, there arose the various problems as described in relation to the Related Art.

Thus, according to the illustrated embodiment of the present invention, the photosensitive drum 10 in the process cartridge 2 is rotatingly driven via the transfer drum 3, so that, when the process cartridge 2 is positioned in the image forming system 1, the photosensitive drum 10 may be positioned only with respect to the transfer drum 3. In this way, the mounting and dismounting of the process cartridge 2 with respect to the image forming system 1 can be facilitated, and the photosensitive drum can automatically be positioned with respect to the drive means, merely by positioning the photosensitive drum with respect to the transfer drum. Further, the photosensitive drum 10 and the transfer drum 3 can be rotated in synchrony with each other with high accuracy, thus improving the image quality.

Further, since only one positioning location for the photosensitive drum 10 is required, the rotational accuracy of the photosensitive drum 10 now depends primarily upon the manufacturing accuracy of the parts, and accordingly is improved.

Now, concrete examples of a rotational force transmitting path when the photosensitive drum 10 is rotatingly driven by the transfer drum 3 will be explained with reference to FIGS. 1 to 4. Incidentally, these examples may include a case where an intermediate transfer member for temporarily holding an image formed on an image bearing member is used as a transfer member, in addition to the transfer drum 3.

Figure 1:
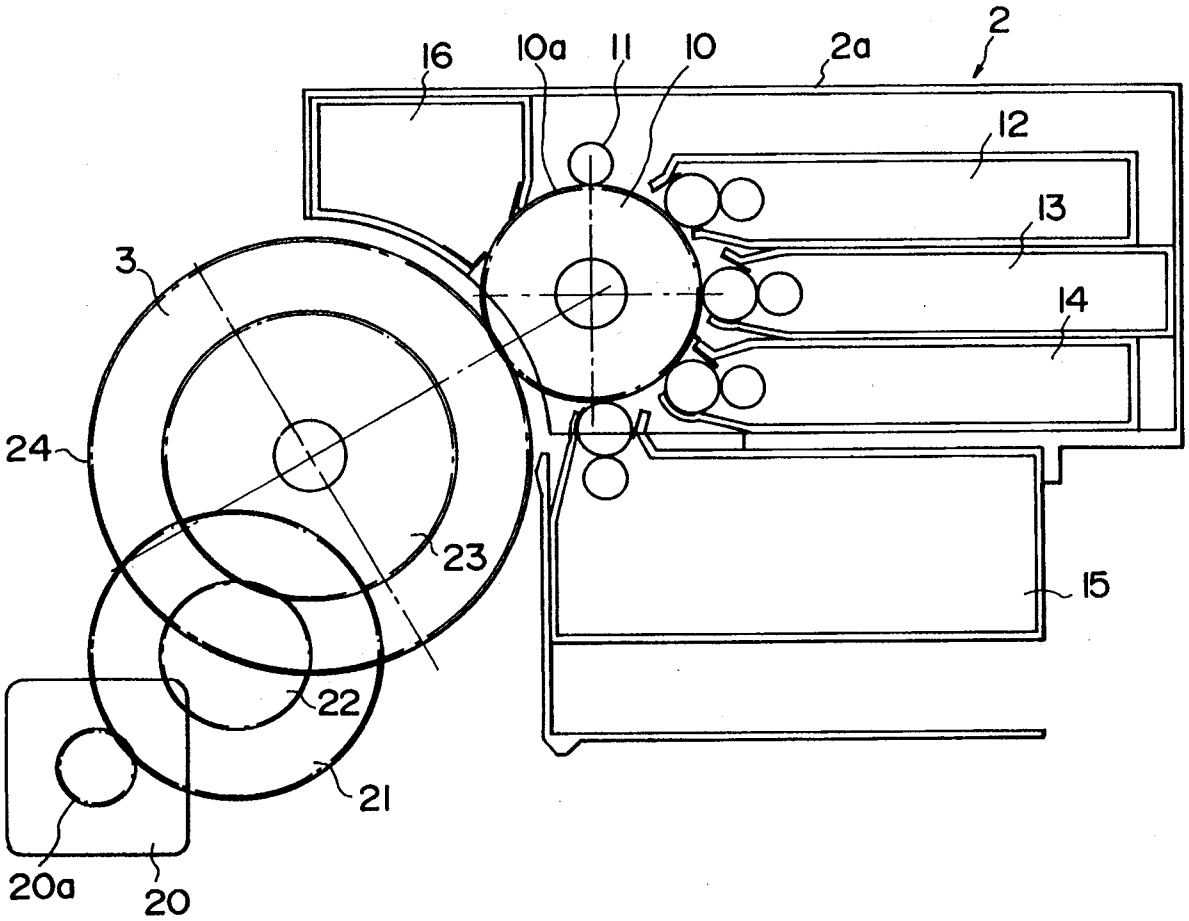
FIG. 1 is an elevational sectional view of a first embodiment of the present invention, showing a driving force transmitting path from a drive source to an image bearing member in a process cartridge.

FIG. 1 shows a first rotational force transmitting path which is formed by first and second idler gears 21 and 22 coaxially fixed on a common shaft between a drive motor 20 and the transfer drum 3, and first and second gears 23 and 24 fixed to a common shaft coaxial with the transfer drum 3; a drive gear 20*a* of the drive motor 20 being meshed with the first idler gear 21, the second idler gear 22 being meshed with the first gear 23 of the transfer drum 3, and the second gear 24 of the transfer drum 3 being meshed with a drum gear 10*a* of the photosensitive drum 10.

Thus, the first and second idler gears 21 and 22 and the first and second gears 23 and 24 are rotated by the drive gear 20*a* of the drive motor (drive source) 20 to rotate the transfer drum 3, with the result that the second gear 24 of the transfer drum 3 rotates the drum gear 10*a*, thus rotating the photosensitive drum 10. That is to say, the photosensitive drum 10 in the process cartridge 2 is rotated via the transfer drum 3. When the process cartridge 2 is positioned in an image forming system, the driving force of the drive source 20 can be automatically transmitted to the photosensitive drum 10 merely by positioning the drum gear 10*a* of the photosensitive drum 10 with respect to the second gear 24 of the transfer drum 3 with high accuracy.

Next, a second embodiment of the present invention will be explained.

Figure 2:
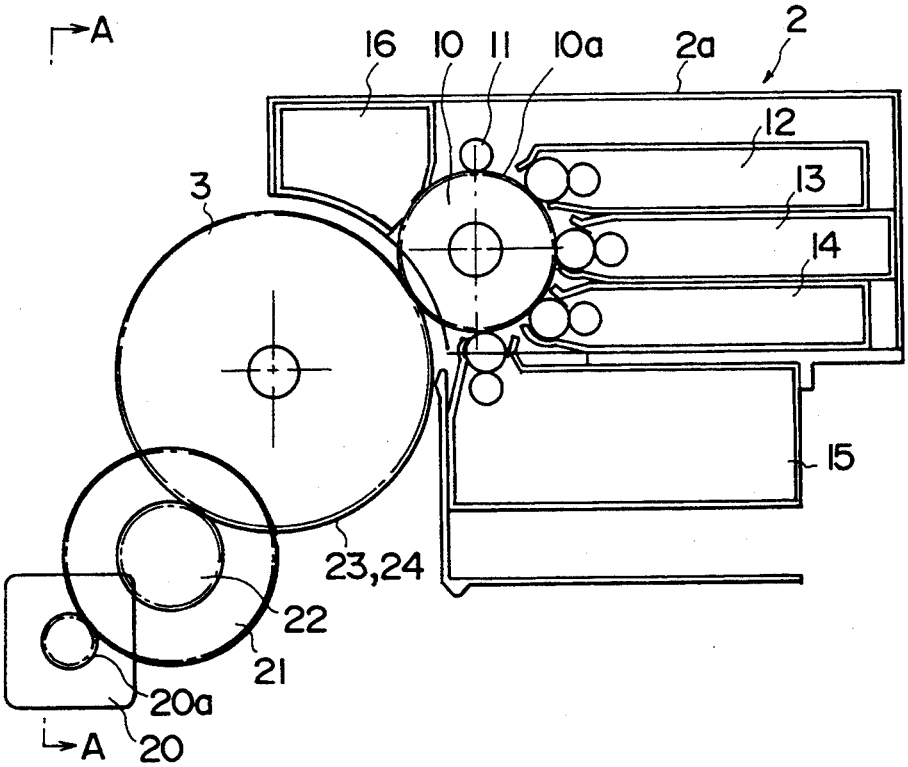
FIG. 2 is an elevational sectional view showing a driving force transmitting path according to a second embodiment of the present invention.
Figure 3:
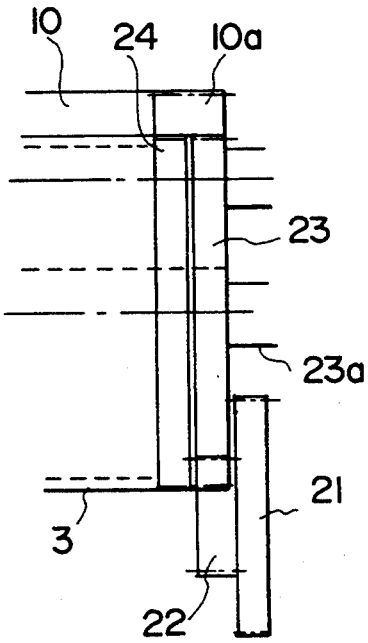
FIG. 3 is a partial sectional view of the system of FIG. 2 taken along the line A—A in FIG. 2.

FIG. 2 shows a second rotational force transmitting path, and FIG. 3 is a view looked at from the line A—A of FIG. 2. In this embodiment, the first and second concentric gears 23, 24 of the transfer drum 3 have the same diameter and are both meshed with the drum gear 10*a* of the photosensitive drum 10, and the second gear 24 is fixed to the transfer drum 3 and the first gear 23 is fixed on another rotary shaft 23*a*.

In this case, the first idler gear 21 is rotated by the drive gear 20*a* of the drive motor 20, and the first gear 23 is rotated via the second idler gear 22 rotated together with the first idler gear 21. The drum gear 10*a* is rotated via the first gear 23 and the second gear 24 is rotated via the drum gear 10*a*, thus rotating the transfer drum 3. In this case, when the process cartridge 2 is positioned in the image forming system 1, the driving force of the drive source 20 can be automatically transmitted to the photosensitive drum 10 merely by positioning the drum gear 10*a* of the photosensitive drum 10 with respect to the first and second concentric gears 23 and 24 with high accuracy.

Next, a third embodiment of the present invention will be explained.

Figure 4:
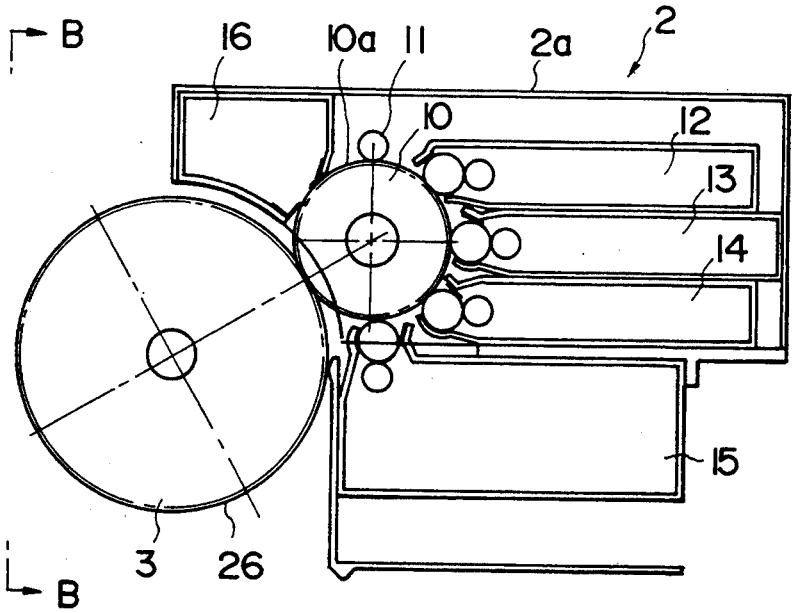
FIG. 4 is an elevational sectional view showing a driving force transmitting path according to a third embodiment of the present invention.
Figure 5:
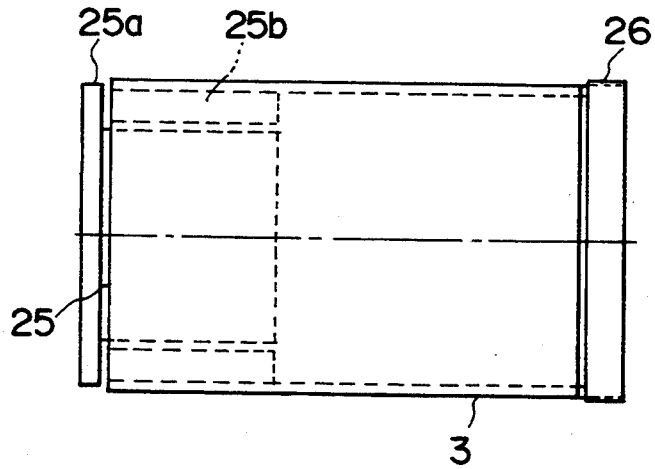
FIG. 5 is a view of the system of FIG. 4 looked at from the line B—B in FIG. 4.

FIG. 4 shows a third rotational force transmitting path, and FIG. 5 is a view looked at from the line B—B of FIG. 4. In this embodiment, the transfer drum 3 is rotated by a direct drive motor 25 and a transfer gear 26 fixed to the transfer drum 3 is meshed with the drum gear 10*a* of the photosensitive drum 10. The direct drive motor 25 has a stator 25*a* fixed to the image forming system 1, and a rotor 25*b* incorporated into the transfer drum 3. Thus, the transfer drum 3 is rotated in response to the rotation of the rotor 25*b* of the direct drive motor 25, with the result that the drum gear 10*a* is rotated via the transfer gear 26, thus rotating the photosensitive drum 10.

Next, a fourth embodiment of the present invention will be explained.

Figure 6:
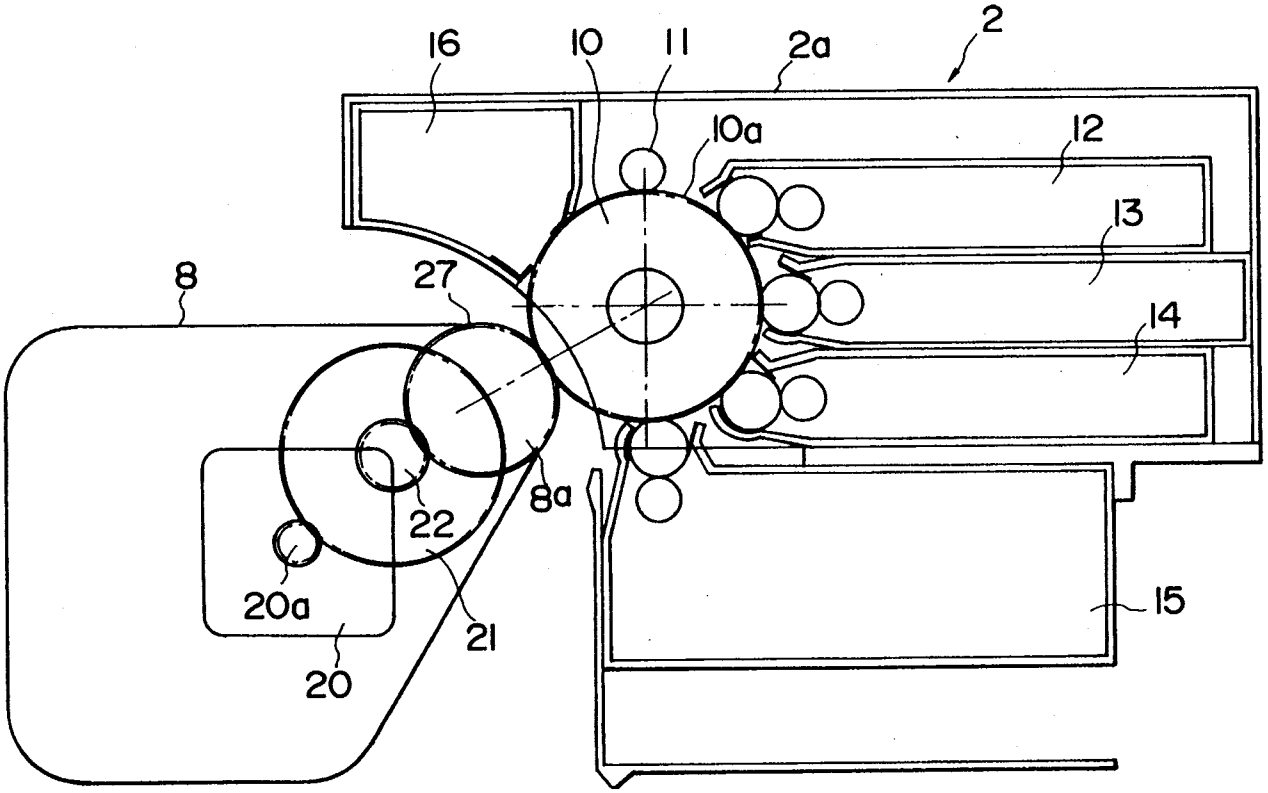
FIG. 6 is an elevational sectional view showing a driving force transmitting path according to a fourth embodiment of the present invention.

FIG. 6 shows a fourth rotational force transmitting path. In this embodiment, in place of the transfer drum 3, an intermediate transfer member 8, comprising an endless sheet, is used as an image forming means, and a roller gear 27, meshed with both the drum gear 10*a* and the second idler gear 22, is fixed to a roller 8*a* for rotating the intermediate transfer member 8.

In this case, the first idler gear 21 is rotated by the drive gear 20*a* of the drive motor 20, and the roller gear 27 is rotated via the second idler gear 22 rotated together with the first idler gear 21. By the rotation of the roller gear 27, the roller 8*a* is rotated to rotatingly drive the intermediate transfer member 8 and, at the same time, the drum gear 10*a* is also rotated, thus rotating the photosensitive drum 10 in synchrony with the intermediate transfer member 8. The various color toner images formed on the photosensitive drum 10 are superimposed on the intermediate transfer member 8, and the toner images are transferred onto the transfer sheet collectively via the intermediate transfer member 8. Incidentally, the intermediate transfer member 8 may be in the form of a drum, rather than the endless sheet.

Next, further embodiments of the present invention will be explained with reference to FIGS. 8 to 14. Incidentally, the same structural elements having the same function as those shown in the above-mentioned first to fourth embodiments are designated by the same reference numerals and the detailed explanation thereof is omitted.

In fifth to eighth embodiments described hereinbelow, a flywheel (inertia member) 30 is provided on the transfer drum (image forming means) 3 of the image forming system or on the roller 8*a* of the intermediate transfer member 8 to rotate the transfer drum 3 or the roller 8*a* smoothly and also to rotate the eliminating the uneven rotation of the transfer drum 3, intermediate transfer member 8 and photosensitive drum 10. Incidentally, the principle of the present invention that a photosensitive drum 10 in the process cartridge capable of forming the multi-color image is rotated via the image forming means such as the transfer drum 3 and the like will be applied to these embodiments as it is.

The fifth embodiment will now be described.

Figure 8:
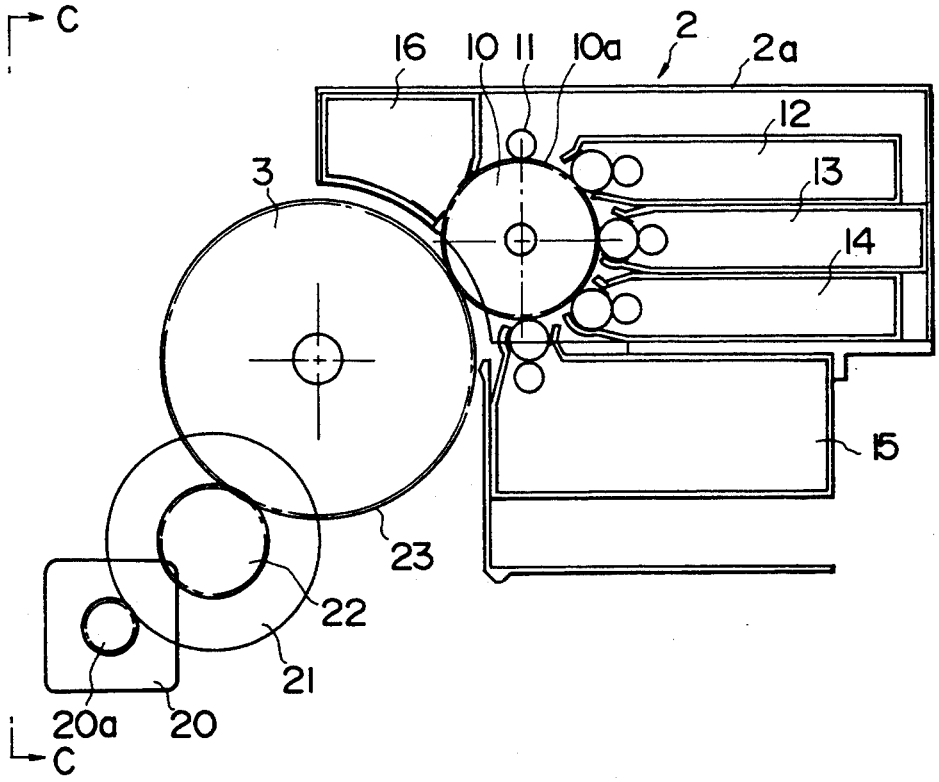
FIG. 8 is an elevational sectional view showing a driving force transmitting path according to a fifth embodiment of the present invention.
Figure 9:
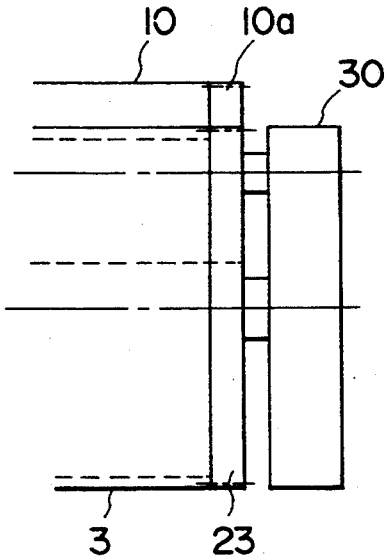
FIG. 9 is a view of the system of FIG. 8 looked at from the line C—C in FIG. 8.

FIG. 8 shows a fifth rotational force transmitting path to transmit the rotational force to the photosensitive drum 10 similar to that shown in FIG. 1. However, in this fifth embodiment, in place of the second gear 24, a flywheel 30 is provided on the transfer drum 3, and the first gear 23 of the transfer drum is meshed with the drum gear 10*a* of the photosensitive drum 10. Incidentally, FIG. 9 is a view looked at from the line C—C of FIG. 8.

In this case, the first idler gear 21 is rotated by the drive gear 20*a* of the drive motor 20, and the first gear 23 of the transfer drum 3 is rotated via the second idler gear 22 rotated together with the first idler gear 21, thus rotating the transfer drum 3. The drum gear 10*a* is rotated by the rotation of the first gear 23, thus rotating the photosenstive drum 10. In this case, since the flywheel 30 is disposed on the transfer drum 3 coaxially with the first gear 23, the flywheel 30 is rotated together with the transfer drum 3, so that the transfer drum 3 can be rotated smoothly, by thus eliminating the rotational unevenness of the drum by the inertia load of the flywheel 30.

As to the photosensitive drum 10 in the process cartridge 2, since the drum gear 10*a* of the drum 10 is positioned with respect to the first gear 23 of the transfer drum 3 with high accuracy and, further. Since the rotation of the transfer drum 3 is transmitted to the photosensitive drum 10 with high accuracy, the rotation accuracy of both the transfer drum 3 and the photosensitive drum 10 are improved. Accordingly, the photosensitive drum 10 can be rotated smoothly by eliminating the rotational unevenness of the drum under the influence of the flywheel 30.

Next, a sixth embodiment of the present invention will be described.

Figure 10:
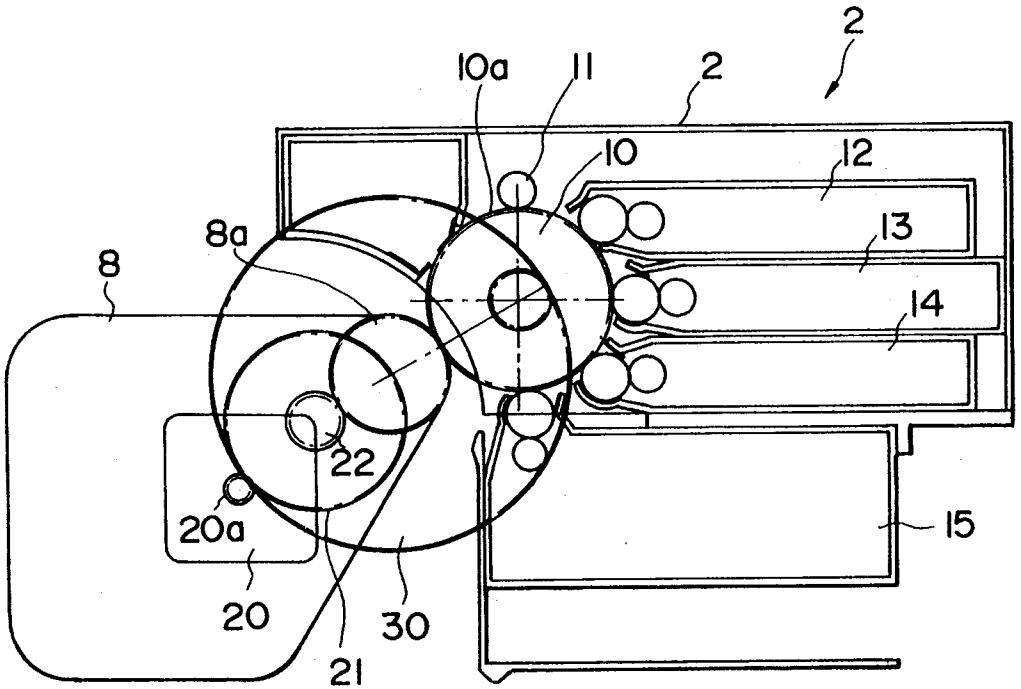
FIG. 10 is an elevational sectional view showing a driving force transmitting path according to a sixth embodiment of the present invention.

FIG. 10 shows a sixth rotational force transmitting path to transmit the rotational force to the photosensitive drum 10 similar to that shown in FIG. 6. However, in this sixth embodiment, a flywheel 30 is disposed on and coaxially with the roller 8*a* for rotatingly driving the intermediate transfer member 8. In this case, the roller 8*a* can be rotated smoothly by eliminating the rotational unevenness of the roller by the rotation of the flywheel 30, and the photosensitive drum 10, rotated via the roller 8*a*, can also be rotated smoothly without any rotational unevenness.

Next, a seventh embodiment of the present invention will be described.

Figure 11:
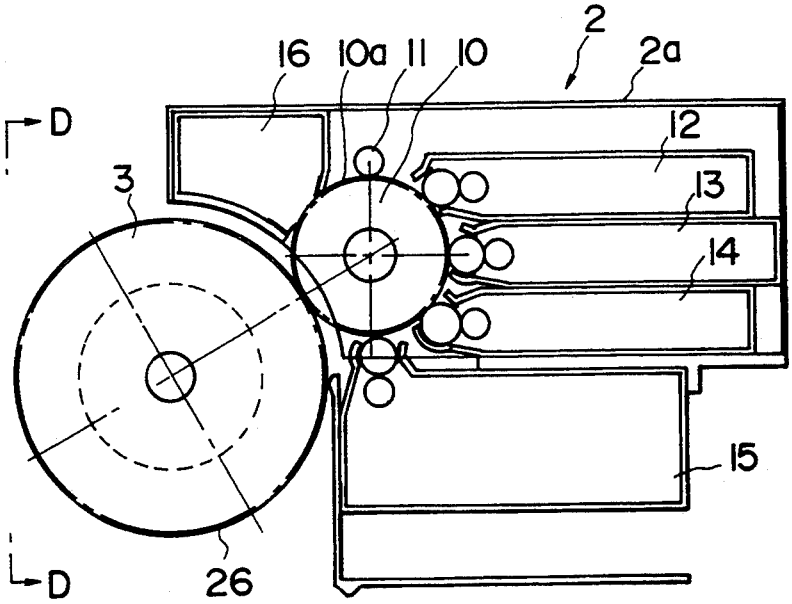
FIG. 11 is an elevational sectional view showing a driving force transmitting path according to a seventh embodiment of the present invention.
Figure 12:
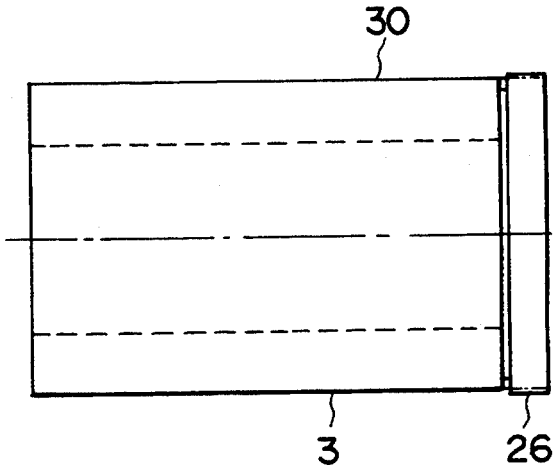
FIG. 12 is a view of the system of FIG. 11 looked at from the line D—D in FIG. 8.
Figure 13:
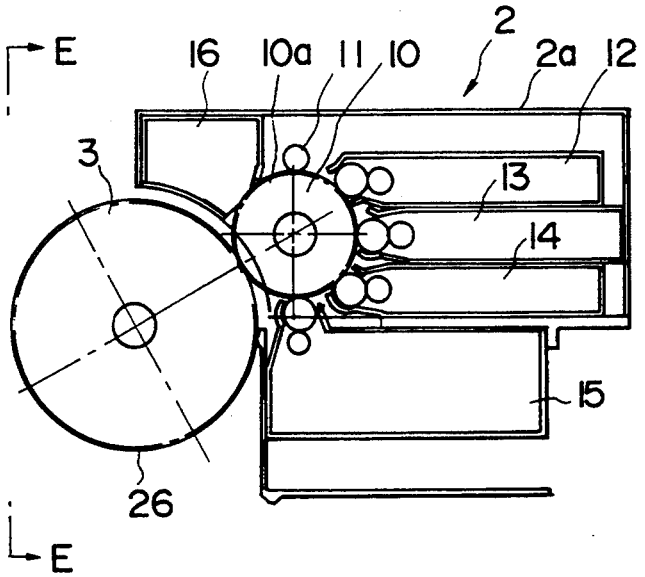
FIG. 13 is an elevational sectional view showing a driving force transmitting path according to an eighth embodiment of the present invention.

FIG. 11 shows a sixth rotational force transmitting path and FIG. 12 is a view looked at from the line D—D of FIG. 11. FIGS. 12 and 13 show a case where the transfer gear 26 of the transfer drum 3 is meshed with the drum gear 10*a* of the photosensitive drum 10 so that the photosensitive drum 10 is rotated via the transfer drum 3. In this case, the inertia load of the transfer drum 3 is increased by increasing a thickness of the transfer drum 3 and by forming the transfer drum from a material having heavier specific weight, so that the transfer drum 3 itself also acts as the above-mentioned flywheel 30. Also in this case, the transfer drum 3 and the photosensitive drum 10 can be rotated smoothly without any rotational unevenness.

Next, an eighth embodiment of the present invention will be described.

Figure 14:
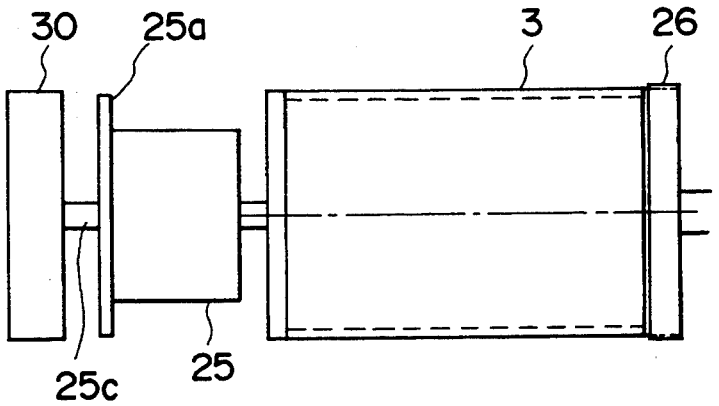
FIG. 14 is a view of the system of FIG. 13 looked at from the line E—E in FIG. 8.

FIG. 13 shows an eighth rotational force transmitting path to transmit the rotational force to the photosensitive drum 10 similar to those shown in FIGS. 4 and 5; and FIG. 14 is a view looked at from the line E—E of FIG. 13. In this embodiment, a flywheel 30 is disposed on a rotary shaft 25*c* of a direct drive motor 25 near a stator 25*a* of the motor. Also in this case, the transfer drum 3 is rotated smoothly without any rotational unevenness by the action of the flywheel 30, and, accordingly, the photosensitive drum 10 rotated via the transfer drum 3 is also rotated smoothly without any rotational unevenness.

Further, of course, the intermediate transfer member 8 may be rotatingly driven by the direct drive motor 25.

Incidentally, in the above-mentioned first to eighth embodiments, while the photosensitive drum acting as the image bearing member was positioned with respect to the image forming means such as the transfer drum or the intermediate transfer member, the present invention is not limited to such embodiments. That is to say, the image forming means used with the present invention may be constituted by any means so long as they act on the image bearing member directly and are driven by the driving force from the drive source. For example, a transfer roller which contacts with an image bearing member when there is no transfer sheet at a transfer station and contacts with the transfer sheet when the latter is in the transfer station to transfer the toner image formed on the image bearing member onto the transfer sheet, or a developing roller in a developing device may be used as the image forming means.

Next, still further embodiments of the present invention will be explained.

In the above-mentioned first to eighth embodiment, the gears were used as the driving force transmitting means.

However, in the above embodiment, there is concern feared that the peripheral speed of the transfer drum or the photosensitive drum becomes uneven and/or the transfer drum or the photosensitive drum is vibrated due to the backlash between the gears of the photosenstive drum and the gears of the transfer drum. As a result, a discrepancy in colors may arise in the transferring of images, giving rise to poor image quality. Further, since the rotational force is transmitted between the photosensitive drum and the transfer drum via the gear train, it is feared that the rotational unevenness of the photosensitive drum is generated at a period corresponding to the gear pitch, thus worsening the image quality. Further, when the process cartridge is mounted within the image forming system, in some cases, the gears of the photosensitive drum are not completely meshed with the gears of the transfer drum, thus causing poor image quality. Furthermore, in some cases, the mounting of the process cartridge is made difficult because of the interference between the gears.

Thus, in ninth to eleventh embodiments described hereinbelow, the driving force is transmitted between the image bearing member and the image forming means via friction wheels.

Incidentally, the structural elements same as those shown in the above first to eighth embodiments are designated by the same reference numerals. Further, in the embodiments described hereinbelow, although an example that a photosensitive drum is rotatingly driven and the driving force of the photosensitive drum is transmitted to a transfer drum will be explained, it is more preferable that the transfer drum is driven, as in the above first to eighth embodiments, due to the reduction in number of the positioning locations when the cartridge is mounted within the image forming system.

Figure 15:
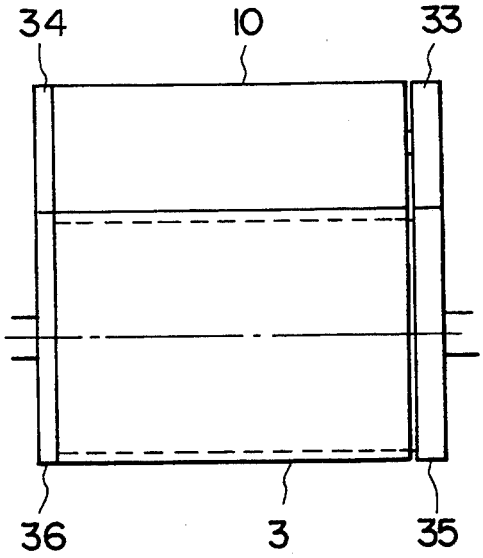
FIG. 15 is a view showing an abutment condition between a transfer drum and a photosensitive drum, according to a ninth embodiment of the present invention.
Figure 16:
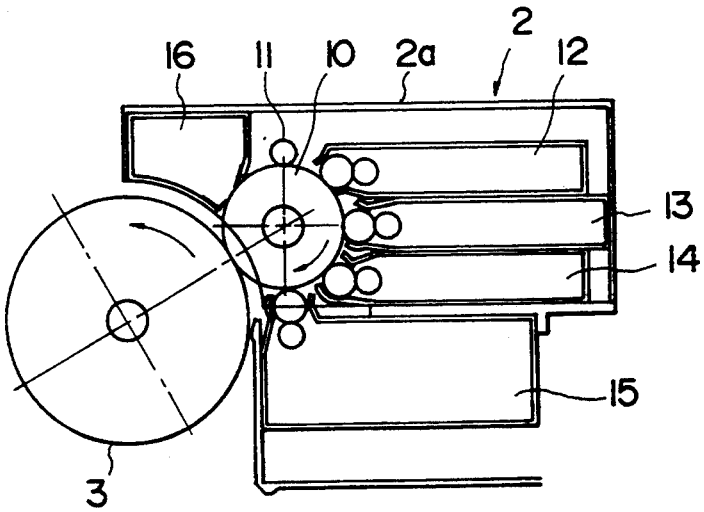
FIG. 16 is an elevational sectional view showing a driving force transmitting path according to the ninth embodiment of the present invention.

First of all, a ninth embodiment of the present invention will be described with reference to FIGS. 15 to 17.

Figure 17:
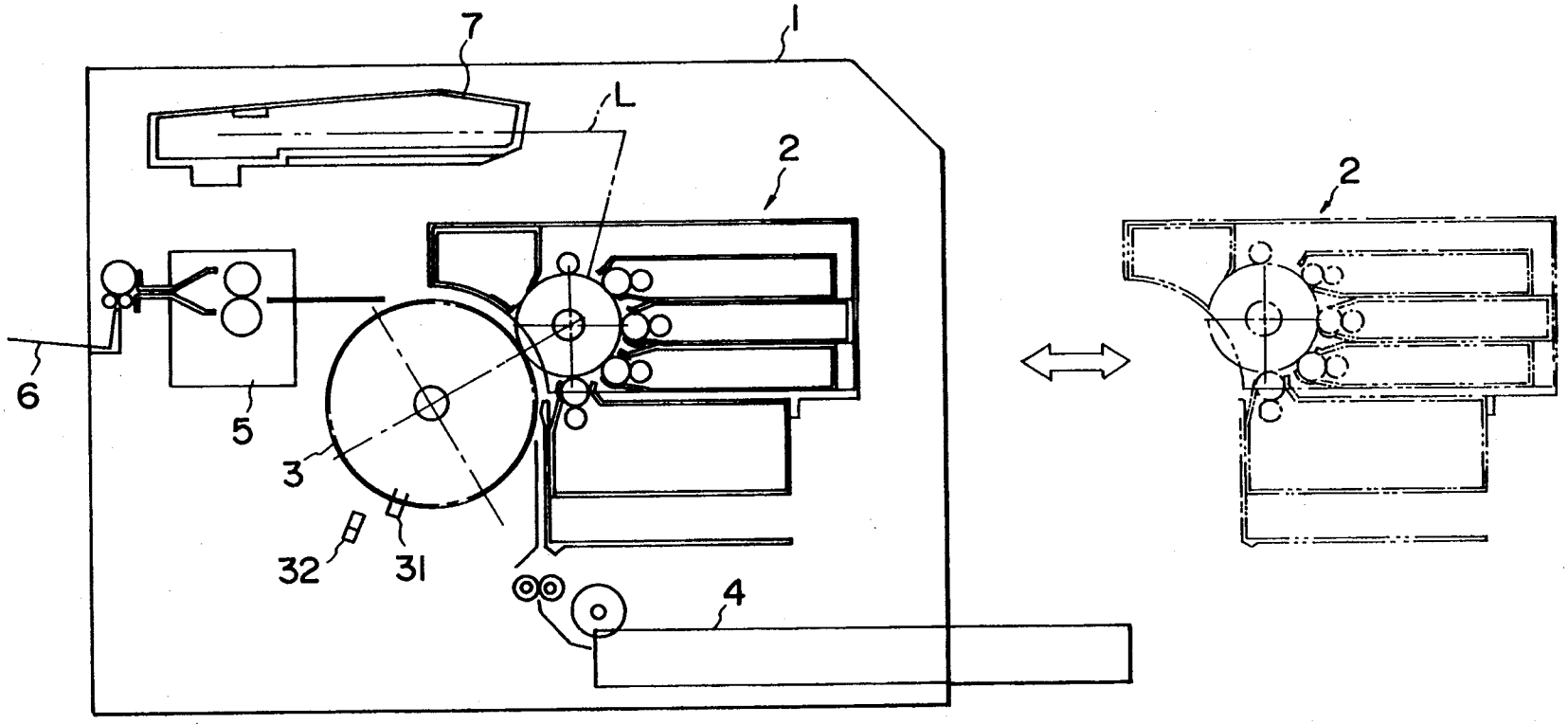
FIG. 17 is an elevational sectional view of an image forming system according to the ninth embodiment of the present invention.

FIG. 17 is an elevational sectional view of an image forming system capable of forming a multi-color image. In FIG. 17, a charger roller 11, four developing devices (yellow, magenta, cyan and black developing devices 12, 13, 14 and 15) including therein yellow toner, magenta toner, cyan tone, and black toner, respectively, and a cleaning device 16 are disposed around a photosensitive drum (image bearing member) 10 rotated in a given direction. These process means 11–16 are integrally housed within a cartridge container 2*a* to form a process cartridge 2 which can be removably or detachably mounted within an image forming system 1, thus facilitating cartridge and apparatus maintenance and the like.

Further, a rotating transfer drum (image forming means) 3 for holding a transfer sheet thereon is disposed adjacent to the photosensitive drum 10 of the image forming system 1. A sheet supply unit 4 is arranged at an upstream side of the transfer drum 3, and a fixing unit 5 and an ejection tray 6 are arranged at a downstream side of the transfer drum. Further, an optical unit 7 is disposed above the process cartridge 2. Incidentally, a projection 31 is formed on the transfer drum 3 so as to be rotated together with the latter, so that the optical unit 7 emits image light L to expose the photosensitive drum 10 when the projection 31 has just passed through a sensor 32 of the image forming system 1.

The image forming process is the same as those of the first to eighth embodiments, and, thus, the explanation thereof is omitted.

The photosensitive drum 10 in the process cartridge 2 must be rotated by a driving member of the image forming system 1, and the transfer drum 3 must be rotated in a given relation to the photosensitive drum 10 since the rotation of the transfer drum must be in synchrony with the rotation of the photosensitive drum 10. In general, the transfer drum 3 was rotated via gears by the photosensitive drum 10. In this case, however, it was feared that the rotational unevenness of the transfer drum 3, and the vibration of the transfer drum 3 and/or the photosensitive drum 10 were generated due to the backlash between the gears.

Thus, according to the illustrated embodiment of the present invention, the transfer drum 3 is rotated by the photosensitive drum 10 via friction wheels. That is to say, as shown in FIG. 15, friction wheels 33 and 34 each having a diameter substantially the same as that of the photosensitive drum 10 are arranged on both ends of the photosensitive drum 10, and friction wheels 35 and 36 each having a diameter substantially the same as that of the transfer drum 3 are arranged on both ends of the transfer drum 3 in confronting relation to friction wheels 33 and 34, respectively. Further, the transfer drum 3 is biased toward the photosensitive drum 10 by means of a spring member and the like so that the friction wheels 35 and 36 of the transfer drum 3 are urged against the friction wheels 33 and 34 of the photosensitive drum 10. In this case, a drive transmitting force determined by the coefficient of friction and urging pressure between the friction wheels 33 and 35 and a drive transmitting force determined by the coefficient of friction and urging pressure between the friction wheels 35 and 36 are selected, respectively, so that these forces always become greater than the variable rotational load of the transfer drum (driven member) 3 under the various circumstances in use. Further, preferably, the above-mentioned two drive transmitting forces are equal to each other.

The friction wheels 33 and 34 of the photosensitive drum 10 are formed from a material (for example, urethane rubber) which has greater coefficient of friction, greater dimensional stability and anti-wear and which permits high dimensional accuracy; whereas, the friction wheels 35 and 36 of the transfer drum 3 have outer surfaces made either of the same material as that of the friction wheels 33 and 34 or of a material providing small projections on the surface by mixing ceramic particles with it. Incidentally, the ratio between the peripheral lengths of the friction wheels 33 and 34 of the photosensitive drum 10 and those of the friction wheels 35 and 36 of the transfer drum 3 is an integral number, so that the relative position between the transfer drum 3 and the photosensitive drum 10, after the photosensitive drum 10 is rotated several revolutions per one revolution of the transfer drum 3, is not changed.

When the process cartridge 2 is mounted within the image forming system 1, the process cartridge 2 is positioned in such a manner that the friction wheels 33 and 34 of the photosensitive drum 10 are urged against the friction wheels 35 and 36 of the transfer drum 3, thus providing the image formation permitting condition. When image formation is started, the frictional driving force is transmitted to the friction wheels 35 and 36 of the transfer drum 3 via the friction wheels 33 and 34 of the photosensitive drum 10, thus rotating the transfer drum 3 at a predetermined speed. In this case, since the driving force transmitting members are constituted by the friction wheels, rather than the gears, the transfer drum 3 is rotated smoothly at a constant speed, with the result that the rotational unevenness, generated when gears are used, can be eliminated, thus preventing the poor image formation. Further, the vibration of the transfer drum 3 and/or the photosensitive drum 10 can also be eliminated.

Further, since the friction wheels can be merely abutted against each other (excluding the delicate positioning in the case of gears) when the process cartridge 2 is mounted within the image forming system 1, the mounting and dismounting of the process cartridge 2 can be facilitated. Moreover, the poor rotation of the transfer drum 3 and/or photosensitive drum 10 due to the poor positioning between these drums can also be eliminated.

Figure 18:
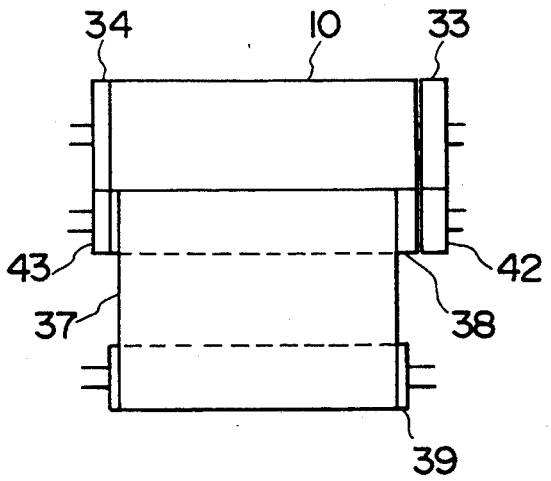
FIG. 18 is a view showing an abutment condition between an intermediate transfer drum and a photosensitive drum, according to a tenth embodiment of the present invention.
Figure 19:
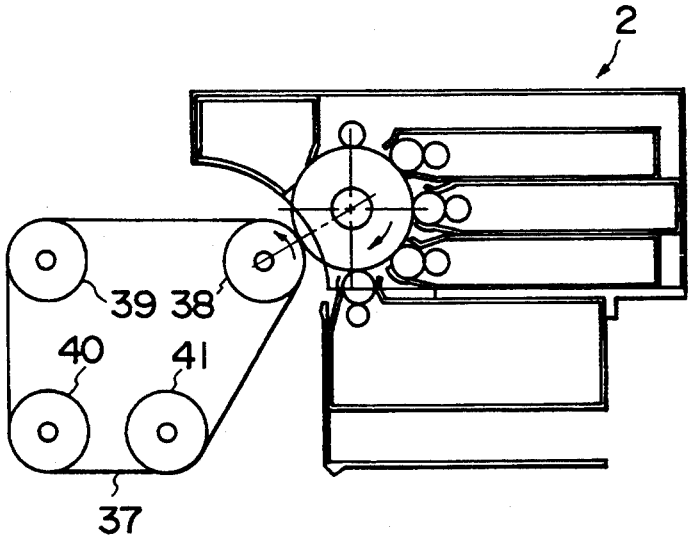
FIG. 19 is an elevational sectional view showing a driving force transmitting path according to the tenth embodiment of the present invention.

Next, a tenth embodiment of the present will be explained with reference to FIGS. 18 and 19. Incidentally, the same structural elements having the same function as those of the previous embodiment are designated by the same reference numerals and the detailed explanation thereof is omitted.

In this embodiment, a sheet-shaped intermediate transfer member 37 is used as the image forming means. The intermediate transfer member 37 is driven and supported by a roller 38 disposed in confronting relation to the photosensitive drum 10 and three tension rollers 39, 40 and 41. After the various color toner images on the photosensitive drum 10 are transferred onto the intermediate transfer member 37 in superimposed fashion, the superimposed toner images are transferred from the intermediate transfer member 37 onto the recording sheet collectively. Accordingly, it is necessary to rotatingly drive the intermediate transfer member 37 in synchrony with the photosensitive drum 10 in a given relation to the latter.

Thus, according to this embodiment, friction wheels 42 and 43 are arranged on both ends of the roller 38, which wheels are adapted to be engaged by the friction wheels 33 and 34 of the photosensitive drum 10 in the process cartridge 2. The friction wheels 42 and 43 of the roller 38 are urged against the friction wheels 33 and 34 of the photosensitive drum 10. With this arrangement, the rotational force from the photosensitive drum 10 is transmitted to the roller 38 via the friction wheels 33, 34 and 42, 43. In this way, this embodiment provides the same technical advantages as those in the ninth embodiment.

Figure 20:
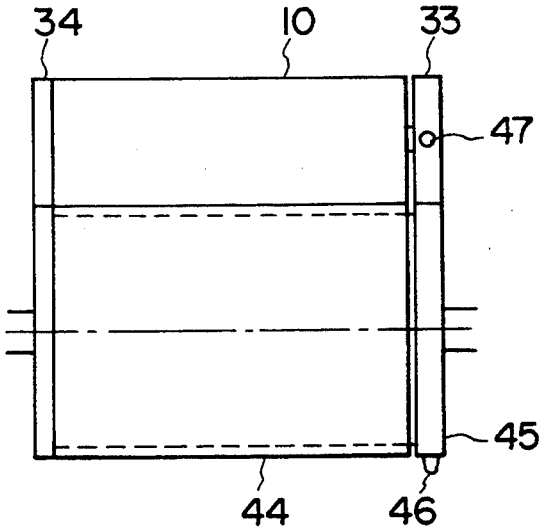
FIG. 20 is a view showing an abutment condition between a transfer drum and a photosensitive drum, according to an eleventh embodiment of the present invention.
Figure 21:
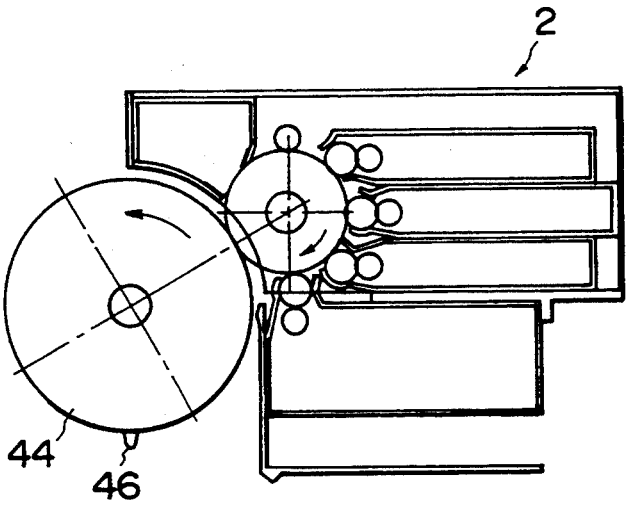
FIG. 21 is an elevational sectional view showing a driving force transmitting path according to the eleventh embodiment of the present invention.

Next, an eleventh embodiment of the present invention will be explained with reference to FIGS. 20 to 22. Incidentally, the same structural elements having the same function as those of the previous embodiment are designated by the same reference numerals and the detailed explanation thereof is omitted.

In this embodiment, an outwardly tapered projection 46 is formed on an outer peripheral surface of one of the friction wheels (friction wheel 45) of a transfer drum 44, and a corresponding adjustment opening 47 which can be engaged by the projection 46 is formed in an outer peripheral surface of one of the friction wheels (friction wheel 33) of the photosensitive drum 10. Now, the ratio between the peripheral lengths of the friction wheels of the photosensitive drum 10 and those of the friction wheels of the transfer drum 44 is an integral number and a diameter of the transfer drum 44 is greater than that of the photosensitive drum 10. Thus, when the transfer drum 44 is rotated by one revolution, the photosensitive drum 10 is rotated several (integral number) revolutions, so that the projection 46 is engaged by the adjustment opening 47, thereby performing the positioning between the photosensitive drum 10 and the transfer drum 44 (rotational position adjustment). Incidentally, the positioning between the photosensitive drum 10 and the transfer drum 44 via the projection 46 and the adjustment opening 47 is effected at a timing when the toner image on the photosensitive drum 10 is not transferred onto the transfer sheet carried by the transfer drum 44 (i.e., when the slip may be caused between the photosensitive drum 10 and the transfer drum 44).

With this arrangement, even if the ratio between the peripheral lengths of the friction wheels of the photosensitive drum and those of the friction wheels of the transfer drum deviates slightly from the integral number, or even if any friction wheel is eccentric with respect to the photosensitive drum or the transfer drum, the superimposition of toner images on the transfer sheet carried by the transfer drum in such a manner as to cause the discrepancy in colors is avoided since the positional relation between the photosensitive drum and the transfer drum can be properly corrected by the projection 46 and the adjustment opening 47. Also in this embodiment, the same technical advantages as those in the ninth and tenth embodiments can be obtained.

Figure 22:
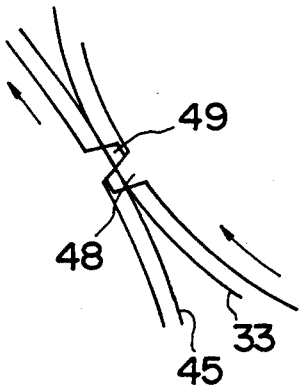
FIG. 22 is a partial enlarged sectional view showing the abutment condition between the transfer drum and the photosensitive drum, according to the eleventh embodiment of the present invention.

Incidentally, in place of the projection 46 and the adjustment opening 47, as shown in FIG. 22, gears 48, 49 may be provided on the friction wheel 33 of the photosensitive drum 10 and the friction wheel 45 of the transfer drum 44, respectively, so that the positional relation between the photosensitive drum 10 and the transfer drum 44 can be corrected by these gears 48, 49.

As apparent from the above, according to the ninth to eleventh embodiments, since the transmission of the driving force between the image forming means of the image forming system and the image bearing member of the process cartridge is effected via the friction wheels, particularly, the rotation of the driven side can be smooth in comparison with the use of the gears, thus eliminating rotational unevenness. As a result, the poor image quality and the vibration of the drums can be avoided. Further, the rotation of the driving side can also be smooth.

Furthermore, the positioning of the image bearing member of the process cartridge relative to the image forming means can be more facilitated in comparison with the use of the gears, thus avoiding the poor image quality from this point.

Next, a twelfth embodiment of the present invention will be explained with reference to FIGS. 23 to 26.

Figure 23:
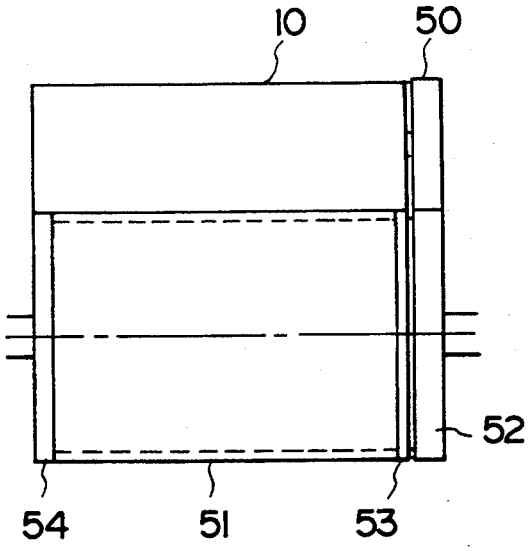
FIG. 23 is a view showing an abutment condition between a transfer drum and a photosensitive drum, according to a twelfth embodiment of the present invention.
Figure 24:
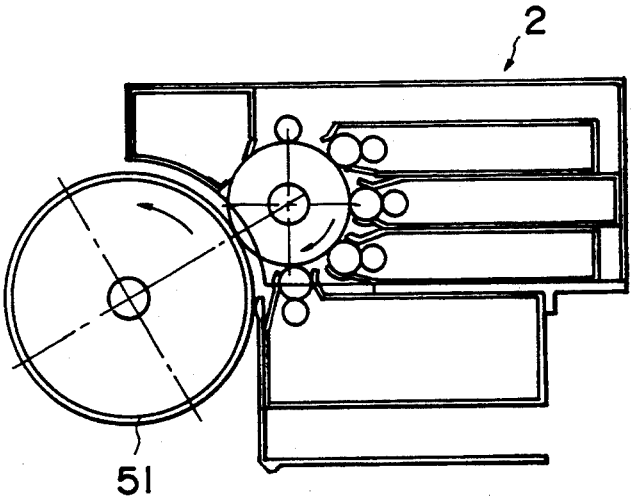
FIG. 24 is an elevational sectional view showing a driving force transmitting path according to the twelfth embodiment of the present invention.

As shown in FIG. 23, a drum gear 50 arranged at one end of a photosensitive drum 10 is meshed with a transfer gear 52 arranged at one end of a transfer drum 51, and friction force transmitting layers 53, 54 acting as friction wheels having greater diameters than that of the transfer drum are formed on the transfer drum 51 at both its end portions. The transfer drum 51 is biased toward the photosensitive drum 10 so that the friction force transmitting layers 53, 54 are urged against a peripheral surface of the photosensitive drum. Incidentally, the friction force transmitting layers 53, 54 are formed from elastic material such as urethane rubber, CR rubber or the like, so that, when the transfer drum 51 is biased toward the photosensitive drum 10, the rotational force of the photosensitive drum 10 can adequately be transmitted to the transfer drum 51 via the friction force transmitting layers and the gears.

In this case, the product $F\mu$ of friction coefficiency $\mu$ between the friction force transmitting layers 53, 54 and the photosensitive drum 10 and the urging force F between the transfer drum 51 and the photosensitive drum 10 are so selected as to be sufficiently greater than the expected maximum driving load in consideration of the load variation of the transfer drum 51. For example, when the driving load of the transfer drum 51 at the outer periphery thereof is 1 kgf and the urging force F between the transfer drum 51 and the photosensitive drum 10 is 2 kgf, the friction coefficiency $\mu$ should be equal to or greater than 0.5 ($\mu > 0.5$).

Figure 25:
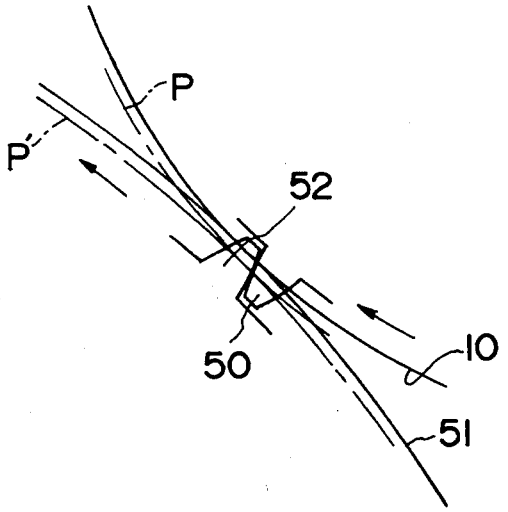
FIG. 25 is a partial enlarged sectional view showing the abutment condition between the transfer drum and the photosensitive drum, according to the twelfth embodiment of the present invention.

Now, as shown in FIG. 25, an outer diameter of the photosensitive drum 10 is selected to be smaller than a diameter of a pitch circle P of the drum gear 50. Accordingly, the outer diameters of the friction force transmitting layers 53 and 54 of the transfer drum 51 contacting with the outer peripheral surface of the photosensitive drum 10 are greater than a diameter of a pitch circle P' of the transfer gear 52. Thus, when the process cartridge 2 is mounted within the image forming system 1 and the drum gear 50 is meshed with the transfer gear 52, the friction force transmitting layers 53 and 54 of the transfer drum 51 are urged against the outer peripheral surface of the photosensitive drum 10. In this condition, when the photosensitive drum 10 is rotated by the driving member (not shown) of the image forming system, to perform the image formation, the drum gear 50 tries to rotate the transfer drum 51 via the transfer gear 52, while the photosensitive drum 10 itself tries to rotate the transfer drum 51 via the friction force transmitting layers 53 and 54.

In this case, since the diameter of the pitch circle P of the drum gear 50 is greater than the diameter of the peripheral surface of the photosensitive drum 10 and the peripheral speed of the drum gear 50 at the pitch circle P is greater than that of the peripheral surface of the photosensitive drum 10, the transfer drum 51 is rotatingly driven by the drum gear 50 via the transfer gear 52. The friction force transmitting layer 53 and 54 of the transfer drum 51 are rotated with a slight slip between themselves and the photosensitive drum 10.

Accordingly, even when the clearance is generated between the teeth to be engaged due to the backlash between the drum gear 50 and the transfer gear 52, i.e., the situation wherein the transfer gear 52 is not rotated by the drum gear 50 but rather, the transfer drum 51 is rotated by the photosensitive drum via the friction force transmitting layers 53 and 54, the transfer drum 51 continues to be rotated without any reduction in speed. As a result, the vibration of the transfer drum 51 and/or the photosensitive drum 10 due to the collision of the tooth of the drum gear 50 against the transfer gear 52 (which is caused by the instantaneous reduction in speed of the transfer drum) can effectively be prevented. The rotational unevenness of the transfer drum 51 itself due to the instantaneous reduction in speed of the transfer drum can also be prevented, thus avoiding the poor image quality.

Further, when the load variation is generated on the transfer drum 51 (driven side), a clearance is likely to be generated between the teeth to be engaged. However, also in this case, since the transfer drum is driven by the friction force transmitting layers 53 and 54, the above-mentioned drawbacks can be avoided.

As mentioned above, according to the illustrated embodiment, since not only the gears and the friction wheels, but also the diameter of the photosensitive drum 10 is used for transmitting the friction force is slightly smaller than the diameter of the pitch circle P of the drum gear 50 of the photosensitive drum 10 (driving side), the transfer drum 51 is rotated via the drum gear 50 and the transfer gear 52, and is rotated by the photosensitive drum 10 via the friction force transmitting layers 53, 54 without any reduction in speed, even when a clearance is generated between the teeth of the gears 50, 52, thus avoiding the inconvenience in the transfer drum 51 and/or the photosensitive drum 10. Further, even when the friction force transmitting layers 53 and 54 are provided on the transfer drum 51, the system does not become large-sized and nor does the mounting and dismounting operability of the process cartridge 2 with respect to the image forming system worsen.

Figure 26:
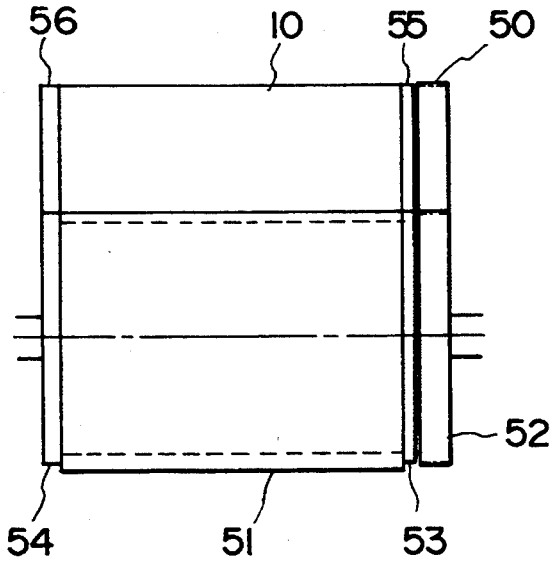
FIG. 26 is a view showing an alteration of FIG. 25.

Incidentally, as shown in FIG. 26, friction force transmitting layers 55 and 56 are made of an elastic material or fuzed ceramic particles may be provided on the peripheral surface of the photosensitive drum 10 in correspondence to the friction force transmitting layers 53, 54.

Figure 27:
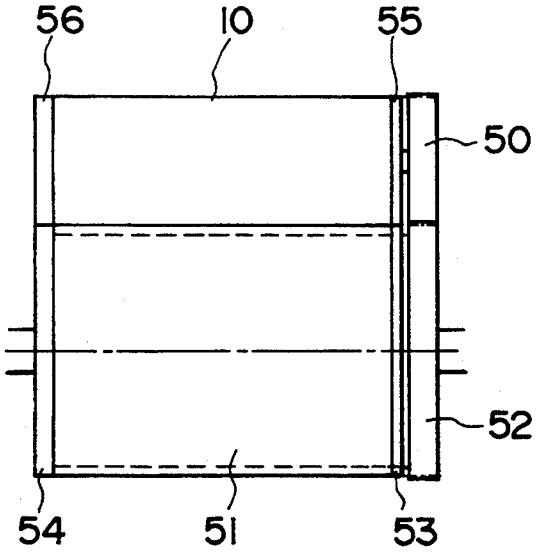
FIG. 27 is a view showing an abutment condition between a transfer drum and a photosensitive drum, according to a thirteenth embodiment of the present invention.
Figure 28:
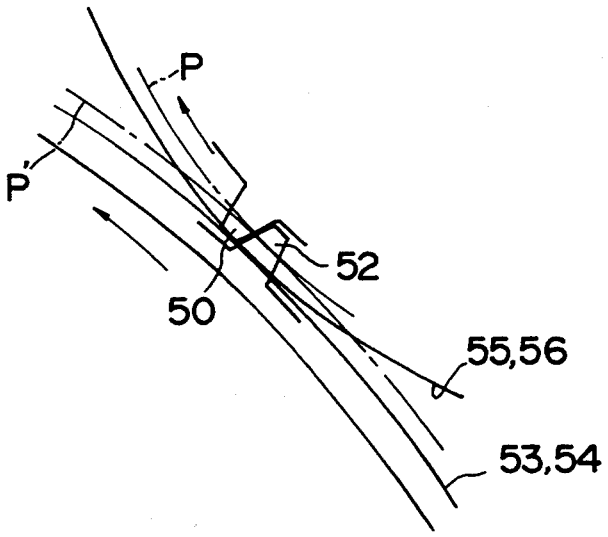
FIG. 28 is a partial enlarged sectional view showing the abutment condition between the transfer drum and the photosensitive drum, according to the thirteenth embodiment of the present invention.

Next, a thirteenth embodiment of the present invention will be explained with reference to FIGS. 27 and 28. Incidentally, the same structural elements having the same function as those in the above-mentioned embodiments are designated by the same reference numerals and the detailed explanation thereof is omitted.

Also in this thirteenth embodiment, the transfer drum 51 is rotated by the photosensitive drum 10 via the drum gear 50 and the transfer gear 52 and is also rotated by the photosensitive drum 10 via the friction force transmitting layers 53 and 54 on the transfer drum and the friction force transmitting layers 55 and 56 on the photosensitive drum 10. Further, as shown in FIG. 28, the outer diameters of the friction force transmitting layers 55 and 56 of the photosensitive drum 10 are greater than the diameter of the pitch circle P of the drum gear 50.

With this arrangement, when the process cartridge 2 is mounted within the image forming system and the photosensitive drum 10 is rotated by a drive source (not shown), since the diameter of the pitch circle P of the drum gear 50 is smaller than the outer diameters of the friction force transmitting layers 55 and 56 of the photosensitive drum 10 and the peripheral speeds of the friction force transmitting layers 55 and 56 are greater than the peripheral speed of the drum gear 50 at its pitch circle P, the transfer drum 51 is rotatingly driven by the photosensitive drum 10 via the friction force transmitting layers 53, 54, 55 and 56. However, as shown in FIG. 28, since a front face (in a rotating direction) of the tooth of the transfer gear 52 of the transfer drum 51 cannot advance beyond a rear surface (in a rotating direction) of the tooth of the drum gear 50, the transfer gear 51 is rotated at a speed defined by the peripheral speed of the pitch circle P′ of the transfer gear 52 of the transfer drum 51, with the result that the friction force transmitting layers 53 and 54 of the transfer drum 51 are rotated with the slight slip between themselves and the photosensitive drum 10.

Accordingly, in this thirteenth embodiment, the same technical advantages as those obtainable by the twelfth embodiment can be obtained.

Figure 29:
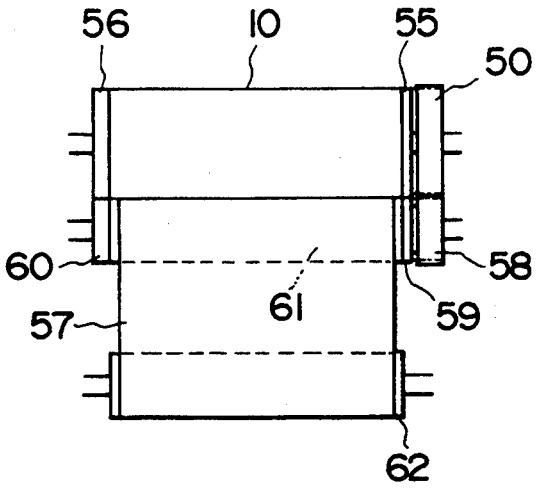
FIG. 29 is a view showing an abutment condition between a transfer drum and a photosensitive drum, according to a fourteenth embodiment of the present invention.
Figure 30:
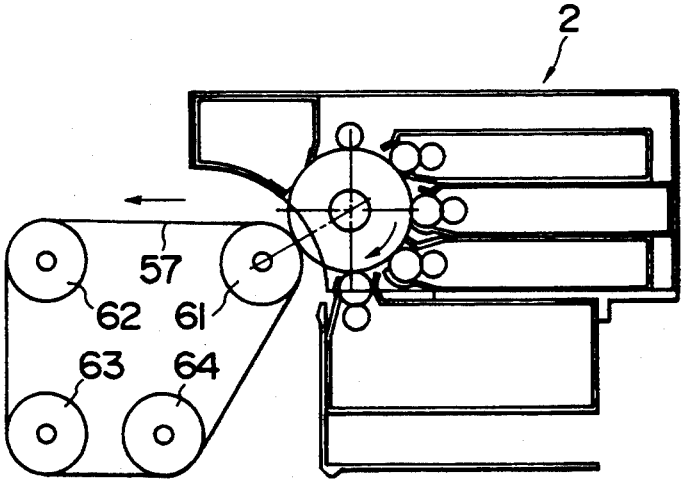
FIG. 30 is an elevational sectional view showing a driving force transmitting path according to the fourteenth embodiment of the present invention.

Next, a fourteenth embodiment of the present invention will be explained with reference to FIGS. 29 and 30. Incidentally, the same structural elements having the same function as those of the previous embodiments are designated by the same reference numerals and the detailed explanation thereof is omitted.

In this embodiment, a sheet-shaped intermediate transfer member 57 is used as the image forming means.

The drum gear 50 of the photosensitive drum 10 is meshed with a roller gear 58 of a roller 61, and the roller 61 is urged against the photosensitive drum 10 via friction force transmitting layers 59, 60, so that the roller 61 can be rotated by the photosensitive drum 10 via both the gears and the friction wheels. Thus, in this embodiment, the same technical advantages as those in the twelfth and thirteenth embodiments can be obtained. It should be noted that the intermediate transfer member 57 is not limited to the sheet-shaped element, but may be constituted by a drum-shaped element.

As in the above-mentioned twelfth to fourteenth embodiments, while the transfer drum, or the intermediate transfer member acting as the transfer means, is rotatingly driven by the photosensitive drum, the photosensitive drum may be rotated via the transfer means such as the transfer drum and the like. Of course, also in this case, the same technical advantages can be expected. Furthermore, the rotational unevenness of the photosensitive drum can be prevented.

As mentioned above, since the shiftable image bearing member can receive the driving force from the shiftable image forming means of the image forming system directly acting on the image bearing member, when the image bearing member is mounted within the image forming system, adherence to specific positioning locations can be relaxed. Thus, the operability of the process cartridge and the like can be improved. Further, the moving accuracy of the image bearing member and/or the image forming means can also be improved.

Further, when the friction wheels are used as the driving force transmitting means, the moving accuracy of the image bearing member and/or the image forming means can be further improved and the positioning of the process cartridge can be facilitated.

The present invention is not limited to the above-mentioned embodiments, but may include all alterations within the scope of the present invention.

What is claimed is:

1. An image forming apparatus comprising: a process cartridge detachably mounted onto said image forming apparatus, said process cartridge including at least an image bearing member having an image bearing surface and a first drive force receiving portion apart from the image bearing for receiving force to drive said image bearing member;

an image receiving means movable for receiving an image formed on said image bearing member, said image receiving means including a recording material bearing surface for bearing a recording material and a second drive force receiving portion apart from the recording material bearing surface for receiving a driving force to drive said image receiving means; and a drive source for driving said image receiving means, wherein when said process cartridge is mounted onto said image forming apparatus, the first drive force receiving portion receives the driving force from said second drive force receiving portion, the recording material borne by the recording material bearing member is contacted with the image bearing surface and the recording material borne on the recording material bearing surface receives the image from the image bearing surface.

2. An image forming apparatus according to claim 1, further comprising transfer means for transferring the image formed on said image bearing member onto the recording material at a transfer station.

3. An image forming apparatus according to claim 2, wherein said image receiving means comprises a drum for bearing the recording material thereon and for conveying the recording material to said transfer station and the image on said image bearing member being transferred onto the recording material.

4. An image forming system apparatus according to claim 1, wherein said image bearing member has a drum-shape.

5. An image forming system apparatus according to claim 1, wherein said image bearing member comprises a photosensitive member.

6. An image forming system apparatus according to claim 1, wherein said process cartridge including said image bearing member and at least one of charger means for uniformly charging said image bearing member, developing means for developing a latent image formed on said image bearing member and cleaning means for removing residual matters remaining on said image bearing member can be detachably mounted within the image forming system.

7. An image forming system apparatus according to claim 6, wherein said process cartridge includes a plurality of developing means.

8. An image forming system apparatus according to claim 6, wherein said developing means includes black developer.

9. An image forming system apparatus according to claim 7, wherein said plurality of developing means include at least one of yellow developer, magenta developer and cyan developer.

10. An image forming system apparatus according to claim 1, wherein said image receiving means comprises an intermediate transfer member for collectively holding the images formed on said image bearing member.

11. An image forming apparatus according to claim 1, wherein each of said first and second drive force receiving portions has a friction wheel.

12. An image forming apparatus according to claim 1, wherein each of said first and second drive force receiving portions has drive gears.

* * * * *

UNITED STATES PATENT AND TRADEMARK OFFICE

CERTIFICATE OF CORRECTION

PATENT NO. : 5,428,426

DATED : June 27, 1995

INVENTOR(S) : MITSUGU INOMATA, ET AL.

It is certified that error appears in the above-identified patent and that said Letters Patent is hereby corrected as shown below:

COLUMN 1

Line 4, "continuation-in-part" should be deleted.
Line 52, "and the" (second occurrence) should read --and, second, the--.
Line 65, "such" should be deleted.

COLUMN 4

Line 5, "and respectively" should read --respectively, and--.
Line 21, "an" should read --a--.
Line 28, "an" should read --a--.
Line 48, "colors" should read --colors,--.

COLUMN 5

Line 67, "gears 23," should read --gears 23 and--.

COLUMN 6

Line 6, "gear 22" should read --gear 22,--.
Line 63, "fifth" should read --the fifth--.
Line 66, "system" should read --system 1--.
Line 68, "to rotate the eliminating" should read --eliminate--.

COLUMN 7

Line 4, "the" should read --a--.
Line 28, "by" should be deleted.
Line 34, "further. Since" should read --further, since--.

UNITED STATES PATENT AND TRADEMARK OFFICE

CERTIFICATE OF CORRECTION

PATENT NO. : 5,428,426

DATED : June 27, 1995

INVENTOR(S) : MITSUGU INOMATA, ET AL.

It is certified that error appears in the above-identified patent and that said Letters Patent is hereby corrected as shown below:

COLUMN 8

Line 38, "embodiment," should read --embodiments,--.
Line 41, "embodiment," should read --embodiments,--.
Line 42, "feared" should be deleted.
Line 61, "ninth" should read --the ninth--.

COLUMN 10

Line 4, "35" should read --34--.
Line 42, "eliminated, thus preventing" should read --eliminated. Thus,--.
Line 43, "formation." should read --formation is prevented.--.
Line 54, "present" should read --present invention--.

COLUMN 11

Line 15, "embodiment" should read --tenth embodiment--.
Line 65, "gears 48," should read --gears 48 and--.

COLUMN 12

Line 2, "gears 48," should read --gears 48 and--.
Line 24, "layers 53," should read --layers 53 and--
Line 29, "layers 53," should read --layers 53 and--
Line 31, "layers 53," should read --layers 53 and--
Line 39, "layers 53," should read --layers 53 and--.
Line 49, "($\mu>0.5$)." should read --($\mu\geq 0.5$).--

UNITED STATES PATENT AND TRADEMARK OFFICE

CERTIFICATE OF CORRECTION

PATENT NO. : 5,428,426

DATED : June 27, 1995

INVENTOR(S) : MITSUGU INOMATA, ET AL.

It is certified that error appears in the above-identified patent and that said Letters Patent is hereby corrected as shown below:

COLUMN 13

Line 10, "layer 53" should read --layers 53--.
Line 45, "layers 53," should read --layers 53 and--.
Line 55, "are" should be deleted.
Line 56, "fuzed" should read --fused--.
Line 59, "53, 54." should read --53 and 54.--.

COLUMN 14

Line 19, "55 and" should read --and 55,--.
Line 44, "layers 59," should read --layers 59 and--.

COLUMN 15

Line 17, "bearing" should read --bearing surface--.

COLUMN 16

Line 7, "system" should be deleted.
Line 10, "system" should be deleted.
Line 13, "system" should be deleted.
Line 22, "system" should be deleted.
Line 25, "system" should be deleted.
Line 28, "system" should be deleted.

UNITED STATES PATENT AND TRADEMARK OFFICE

CERTIFICATE OF CORRECTION

PATENT NO. : 5,428,426

DATED : June 27, 1995

INVENTOR(S) : MITSUGU INOMATA, ET AL.

It is certified that error appears in the above-identified patent and that said Letters Patent is hereby corrected as shown below:

COLUMN 16

Line 32, "system" should be deleted.

Signed and Sealed this

Fifth Day of December, 1995

Bruce Lehman

*Attest:*

BRUCE LEHMAN

*Attesting Officer*

*Commissioner of Patents and Trademarks*